US006807821B2

(12) United States Patent
Narney, II

(10) Patent No.: US 6,807,821 B2
(45) Date of Patent: Oct. 26, 2004

(54) COMPRESSOR WITH INTERNAL ACCUMULATOR FOR USE IN SPLIT COMPRESSOR

(75) Inventor: John Kenneth Narney, II, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 10/644,403

(22) Filed: Aug. 20, 2003

(65) Prior Publication Data

US 2004/0141859 A1 Jul. 22, 2004

Related U.S. Application Data

(63) Continuation-in-part of application No. 10/349,430, filed on Jan. 22, 2003, now Pat. No. 6,637,216.

(51) Int. Cl.[7] ..... F25D 3/02

(52) U.S. Cl. ..... 62/324.6; 62/469; 417/357; 417/410.3; 418/100

(58) Field of Search ..... 62/324.6, 296, 62/469, 498, 503; 417/357, 372, 410.3, 423.1, 423.11; 418/100, DIG. 1

(56) References Cited

U.S. PATENT DOCUMENTS 5,326,231 A * 7/1994 Pandeya et al. ..... 417/271
5,609,478 A * 3/1997 Utter et al. ..... 418/55.5
6,499,971 B2 12/2002 Narney, II et al.
6,537,044 B2 * 3/2003 Chang et al. ..... 418/55.4
6,579,076 B2 * 6/2003 Narney et al. ..... 417/365
6,637,550 B2 * 10/2003 Koyama et al. ..... 184/6.16
6,651,458 B1 * 11/2003 Ebara et al. ..... 62/510
6,672,845 B1 * 1/2004 Kim et al. ..... 417/310
6,715,999 B2 * 4/2004 Ancel et al. ..... 417/310
6,739,847 B1 * 5/2004 Tarng et al. ..... 418/55.1
6,746,224 B2 * 6/2004 Itoh et al. ..... 418/55.2

FOREIGN PATENT DOCUMENTS

DE 003546839 A1 * 9/1991

* cited by examiner

*Primary Examiner*—William Doerrler
*Assistant Examiner*—Mohammad M. Ali
(74) *Attorney, Agent, or Firm*—McNees Wallace & Nurick LLC

(57) ABSTRACT

A rotary compressor having a housing with a motor and an internal accumulator located on the low pressure side and an oil sump located on the high pressure side. A sealing means positioned within the housing defines a first low pressure chamber and a second high pressure chamber. The sealing means substantially maintains the pressure differential between the chambers by segregating high pressure fluid in the high pressure chamber from low pressure fluid in the low pressure chamber. The fluid entering the housing is separated into a gas portion and a liquid portion, the liquid portion being directed downward toward the motor to provide cooling for the motor while the gas portion is directed to a compressor portion through a channeling means internal to the compressor housing. The liquid portion collects above the sealing means. At least one orifice or aperture through the sealing means allows liquid collected above the sealing means to be reintroduced into the compressor suction inlet and metered into the refrigerant gas in a controlled fashion and resupply the sump with lubricant.

22 Claims, 6 Drawing Sheets

COMPRESSOR WITH INTERNAL ACCUMULATOR FOR USE IN SPLIT COMPRESSOR

CROSS REFERENCE TO RELATED APPLICATIONS

This application is a continuation-in-part of application Ser. No. 10,349,430 filed Jan. 22, 2003 now U.S. Pat. No. 6,637,216. This application references application assigned to the assignee of the present invention, identified as to U.S. application Ser. No. 09/726,606, now U.S. Pat. No. 6,499,971 issued Dec. 31, 2002 to Namey entitled "COMPRESSOR UTILIZING SHELL WITH LOW PRESSURE SIDE MOTOR AND HIGH PRESSURE SIDE OIL SUMP," incorporated herein by reference.

FIELD OF THE INVENTION

The present invention is directed to a compressor unit, and more particularly, to a rotary compressor system having a housing with a motor and a fluid accumulator located on the low pressure side and an oil sump located on the high pressure side.

BACKGROUND OF THE INVENTION

In general, a closed rotary compressor forms a part of a heating and air conditioning system (HVAC) refrigerant cycle. A compressor or compressor unit, as used herein, commonly includes a number of components such as a housing, a compressor portion, a motor having a stator and a rotor, bearings, a suction port, a discharge port, an oil sump and an accumulator. Other components may be included depending upon the design of the compressor. Various types of compressors can be used in such applications including reciprocating piston compressors, scroll compressors, rotary compressors and screw compressors. The conventional rotary compressor is a sliding vane compressor having an electric motor arranged in an upper portion of a shell or casing. Compression is accomplished by an impeller or roller which is located on and is rotated by a shaft, at least a portion of which includes an eccentric arrangement and which shaft is coupled to the motor 20. An accumulator is arranged on a side portion of the rotary compressor. As the roller rotates within a cylindrical chamber formed within housing, the impeller or roller contacts the walls of housing. The eccentric rotation of the roller causes refrigerant gas entering into the chamber through suction port to be compressed before it exits an exhaust port (not shown).

Another example of a rotary compressor uses a plurality of blades that rotate on a shaft, thereby providing compression of gas. And the invention is not restricted to rotary compressors. For example, a scroll compressor that utilizes an orbiting scroll rotating in an eccentric manner in a spatial relationship to a fixed scroll may also be used.

These compressors may be high pressure systems or low pressure systems in which the motor and compressor portion of the compressor are contained in a single chamber within a housing.

A high pressure system employs a housing that includes a compressor portion and a motor, and typically an accumulator external to the housing. The motor is contained in a chamber in the housing that is maintained at a high pressure. The housing is provided with a suction tube that draws refrigerant into the compression volume of the compressor portion. The compressed fluid is then discharged into the chamber containing the motor, where the high pressure fluid cools the motor before leaving the housing through a discharge tube. The chamber containing the motor is thus maintained at the compressor discharge pressure.

A low pressure system also employs a housing that includes a compressor portion and a motor. The motor is contained in chamber in the housing that is maintained at low pressure, that is, at compressor suction pressure. In this arrangement, the suction tube draws refrigerant into the chamber where the refrigerant cools the motor before the refrigerant is drawn into the compressor suction port, and thence into the compression volume of the compressor portion where it is compressed. The compressed fluid then is expelled from the compression through the discharge port.

These compressors typically employ an accumulator, such as is shown in FIG. 2, which typically are external to the compressor. The accumulator accumulates lubricant and refrigerant, which may be in the form of liquid, gas or both phases. Ideally, the liquid phase includes solely lubricant and the gaseous phase includes solely refrigerant. However, more typically, the liquid phase also includes refrigerant and the gaseous phase frequently includes lubricant.

There are a number of problems associated with these compressor systems. In high pressure systems, the compressed gas from the discharge port of the compressor is at an elevated temperature, and may provide inadequate cooling of the motor in certain situations, such as during long duty cycles in operating environments with high ambient temperatures. This can cause motor overheating which can lead to premature motor failures and shortened operational life of the compressor. In low pressure systems, difficulties arise because lubrication must be provided to the compressor portion operating at high pressure while preventing the compressed fluid from leaking across the compressor's sealing surfaces. Difficulties can also arise when trying to separate the lubricating oil from the compressed fluid. The lubricant mixed with liquid refrigerant can lower the efficiency of the unit and in extreme cases can result in slugging, discussed below. The liquid refrigerant mixed with lubricant can adversely affect the lubrication of the system as the refrigerant tends to wash the lubricant from the surfaces requiring lubrication, resulting in increased wear and in extreme cases, failure as parts seize. An external accumulator is frequently employed to assist in collecting excess fluid and in separating the lubricant from the refrigerant. The external accumulator is required because the suction tube enters the compressor directly at the inlet port. However, with the suction in this position, there can be a problem with slugging. Slugging is a condition that occurs when a mass of liquid, here from the accumulator, enters the compressor portion. This liquid, when in sufficient volume and being incompressible, adversely affects the operation of the compressor and can cause severe damage.

What is desired is a system that can separate the lubricant from the refrigerant while preventing slugging. Such a system provides substantially only gas to the suction port of the compressor portion, while also desirably cooling the motor, thereby preventing overheating, yet still allowing the lubricant to be circulated into the compressor portion to provide effective lubrication of moving and wear parts.

SUMMARY OF THE INVENTION

The present invention is a compressor comprising a housing and a sealing means positioned within the housing, defining a first chamber and a second chamber. The first chamber is maintained at a first low pressure, or suction pressure, while the second chamber is maintained at a high pressure. The sealing means is positioned within the housing to define and partition the first chamber and the second chamber and to substantially maintain the pressure differential between the chambers by segregating high pressure fluid in the second chamber from low pressure fluid in the first chamber. The sealing means is designed to prevent leakage of fluid from the second or high pressure chamber to the first or low pressure chamber. The sealing means can seal any leak paths that may exist between the chambers. The first chamber is physically located above the second chamber, and the motor is disposed within the first chamber. A compressor portion, which physically compresses fluids, is located within the second chamber.

Fluid, which may be gas or liquid entrained in the gas, is drawn into the first chamber from the HVAC system through a suction tube inlet physically located at the top of the housing. The fluid entering the housing may contact a deflecting means, which assists in separating it into a gas portion and a liquid portion. The liquid portion is directed downward toward a motor. A first quantity of the gas portion is also directed downward while a second quantity of the gas portion is drawn toward a compressor suction inlet. The liquid portion and the gas portion directed downward toward the motor are circulated through passageways around the motor and adjacent the motor stator to provide cooling for the motor. The liquid portion will collect about the motor components above the sealing means. A space or region is provided in the first chamber to permit the accumulation of a substantial amount of fluid. This space or region forms an internal accumulator for the fluid. Heat generated by the motor windings and transferred to the fluid serves to separate the higher boiling point lubricant from the low boiling point refrigerant, as the refrigerant undergoes a phase transformation into a gas and is drawn through a channeling means to the compressor suction inlet during compressor operation. A fluid connection, such as a bleed hole or tube, through the sealing means allows liquid collected above the sealing means in the internal accumulator to move across this boundary in a controlled manner and flow downward to the compressor suction inlet in the second chamber where it can resupply the sump. The bleed connection can be activated by any one of a number of activating means such as control valves, gravity or hydrostatic pressure of the fluid in the internal accumulator. Most simply, however, the operation of the compressor draws the liquid through the bleed connection to the compressor suction inlet.

Gas channeled toward the compressor suction inlet is generally of high quality, that is to say, it contains little or no lubricant. This refrigerant gas enters the compressor portion through the compressor suction inlet, where it is compressed in the compressor volume. The compressor portion is operably connected to the motor by a motor shaft that passes across the sealing means. Activation of the motor in the typical fashion by starting the motor activates the compressor. During operation of the compressor, lubricant is metered through the bleed hole and is compressed with the refrigerant gas as a compressed fluid. As the compressed fluid exits the compressor before it is discharged, the compressed refrigerant gas and entrained lubricant strikes components such as bearings, sidewalls of the housing in the high pressure region of the compressor or other structures in the second chamber that can separate entrained lubricant from the refrigerant gas. The lubricant, present as droplets or as a mist gathers on these surfaces and flows downward to further resupply the sump. The compressed fluid, from which a substantial amount of lubricant has been removed, then moves upward and is discharged at high pressure through a compressor discharge port. Activation of the motor also causes any lubricant residing in the sump to be drawn upward and delivered to the surfaces of the compressor requiring lubrication.

An advantage of the present invention is that it allows for the elimination of an external accumulator, which results in a savings of space in the restricted area where a compressor is located. The simpler design also eliminates the additional cost associated with the manufacture of the external accumulator and the additional time required to assemble and test the external accumulator to the compressor.

Another advantage of the compressor of the present invention is that it can use the motor of the compressor to substantially eliminate liquid refrigerant when the compressor is not operating. By energizing a winding in the motor after shut down, the winding can be used to heat liquid refrigerant to a temperature sufficient to allow it to transform to a gaseous state, thereby allowing the refrigerant to be moved as a gas from the low pressure region around the motor, returning to circulation within the refrigeration loop.

Yet another advantage of the present invention is that the liquid refrigerant and the lubricant are used to cool the motor during and after its duty cycle. At least some of the heat generated by the motor is utilized to convert the refrigerant from a liquid state back into a gaseous state so that it can be returned to circulation within the system, thereby improving the efficiency of the system and reducing the amount of liquid refrigerant that would otherwise be moved into the system. This also reduces the likelihood of slugging.

Another advantage of the present invention is that the lubricant and the refrigerant can be readily separated in the low pressure side. A portion of the lubricant, substantially free of refrigerant, can then be metered back into the gas flow in a controlled manner through the bleed connection. The lubricant, added to refrigerant during the compression cycle, is substantially separated from the compressed refrigerant by interaction with the physical boundaries in the high pressure chamber before being discharged from the compressor.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts.

DETAILED DESCRIPTION OF THE INVENTION

Figure 1:
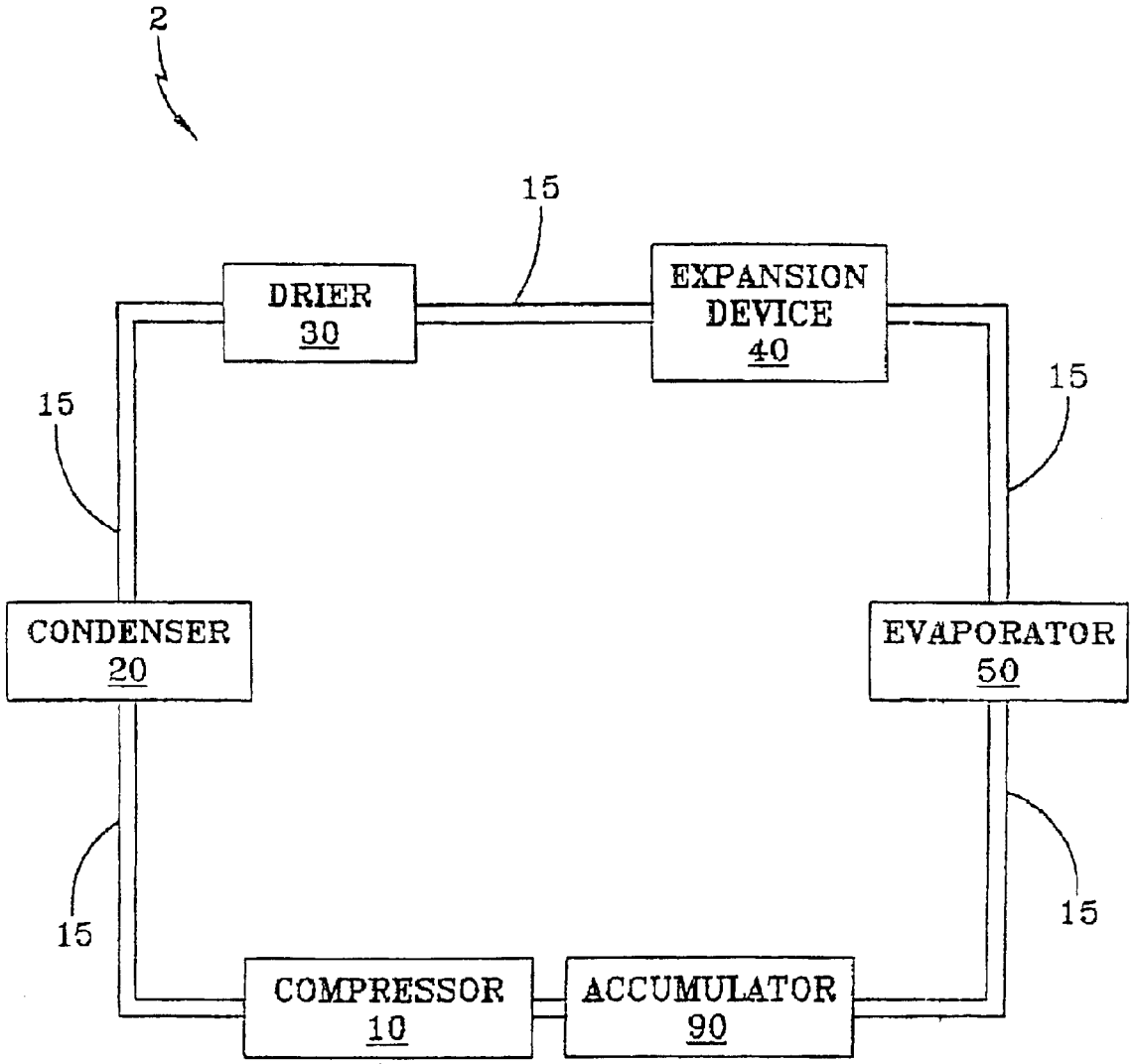
FIG. 1 is a schematic of a typical HVAC system that can be used to heat or cool a space.

FIG. 1 depicts a typical HVAC system 2. A compressor 10 connected to a power source compresses a refrigerant gas when energized by the power source. The substantially compressed fluid is transferred via conduit means 15, tubing, to a condenser 20 where the substantially compressed gas at least partially undergoes a phase change being converted into a high pressure liquid. The change is an exothermic transformation or event, causing the fluid to give up heat which can be distributed into an area to be heated by a blower means (not shown). The fluid is then transferred via conduit means to a drier 30 which removes any water that may be present in the fluid. The fluid is then transferred via conduit 15 to an expansion device 40, which may include a valve or series of valves which causes it to expand, causing the pressure and temperature of the fluid to be lowered. The fluid exits the expansion device 40 via conduit primarily as a cold liquid and is transported to an evaporator 50 where the substantially cold liquid is converted to substantially a gas, although a mixture of gas and liquid is not uncommon. This phase change is an endothermic transformation which absorbs heat from ambient air passing across evaporator 50. The volume of air passing across evaporator is enhanced or increased by use of a blower (not shown). The gas when the unit is operating at peak performance, or typically, a mixture of liquid and gas is transported via conduit 15 to an accumulator 90 where the fluid is stored until there is a demand for the fluid by compressor 10. Although the fluid is primarily refrigerant, typically refrigerant becomes mixed with lubricant that is used to lubricate compressor 10, as will be developed more fully below.

Figure 2:
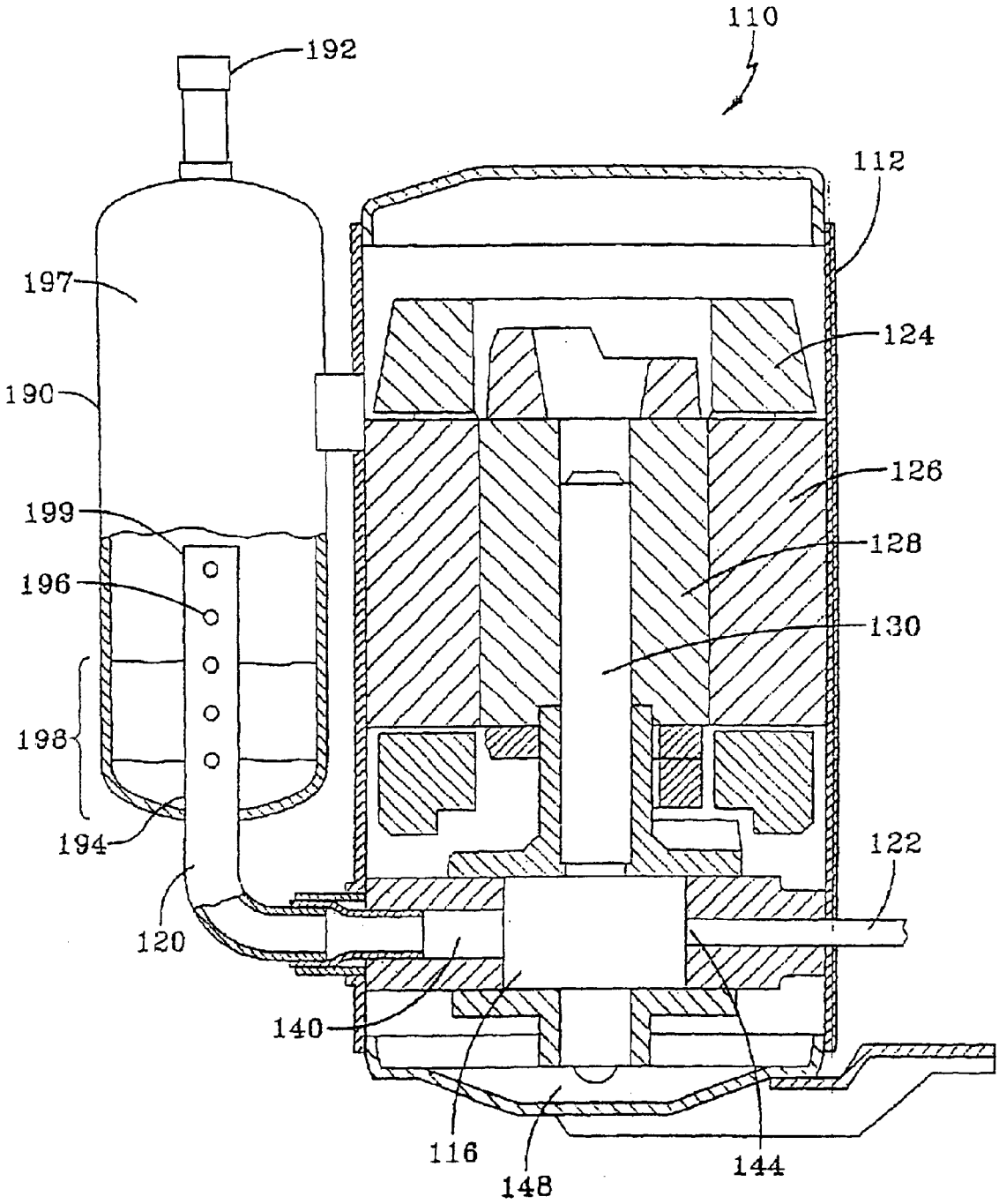
FIG-2 PRIOR ART
FIG. 2 is a cross-section of a prior art compressor having an external accumulator such as may be used in a typical HVAC system of FIG. 1.

FIG. 2 depicts in cross-section, a prior art compressor 110 such as may be used in HVAC system 2 of FIG. 1. Prior art compressor 110 may include any type of compressor design, although this invention is directed primarily toward rotary compressors. This compressor 110 includes a housing 112. Located within housing 112 is a compressor portion 116 and a motor 124. Motor 124 is a typical electrical motor having a motor stator 126 (windings) a motor rotor 128 and a motor shaft 130. Compressor portion 116 is attached to motor shaft 130 and operates when motor stator 126 is activated causing rotation of the rotor 128 and shaft 130. A suction tube inlet 120 draws fluid stored in an accumulator 190 and directs the fluid to a compressor suction inlet 140 where the fluid is acted on in the working area of compressor portion 118 when the motor is activated.

Accumulator 190 includes an accumulator suction pipe 192 connected to a HVAC system such as HVAC system 2 of FIG. 1. An accumulator discharge pipe 194 is in communication with suction tube inlet 120 of compressor 110. Discharge pipe 194 includes an aperture 196 for return of oil to the system. Accumulator 190 is divided into two regions, a first region 197 where refrigerant gas is accumulated and which is in communication with discharge pipe 194 and a second region 198 in which liquid settles. The second region is also in communication with discharge pipe 194 via apertures 196. The liquid is a mixture of refrigerant fluid and lubricant. A small amount of liquid will be drawn through apertures 196 into the compressor to supplement refrigerant gas drawn from first region 197 into top 199 of discharge pipe 194. In certain situations, the level of liquid in the accumulator 190 can rise above discharge pipe 194, expanding the volume of the second region. When compressor 110 is activated, the undesirable condition of slugging can occur, as incompressible liquid from the accumulator fills the working zone of compressor portion 116. Oil enters a small hole 196 inside the accumulator and is metered back into the system.

Figure 3:
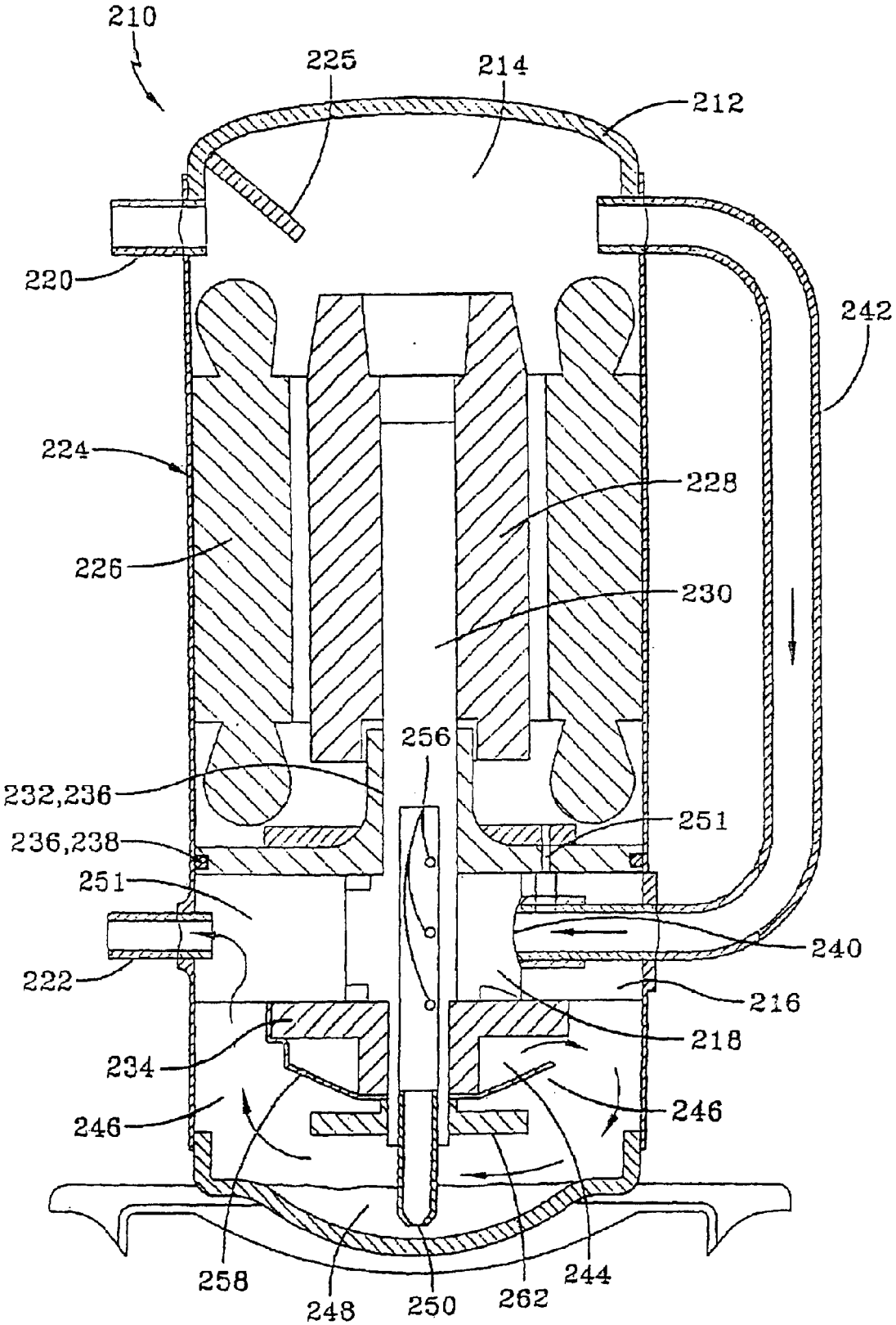
FIG. 3 is a cross-section of a first embodiment of the compressor of the present invention that can be used to replace the compressor and accumulator in a HVAC system of FIG. 1.

FIG. 3 provides an embodiment of the compressor 210 of the present invention. This compressor 210 comprises a housing 212 and a sealing means 236 positioned within housing 212 that defines a first chamber 214 and a second chamber 246 within housing 212. First chamber 214 is maintained at a first suction pressure while second chamber 246 is maintained at a second pressure above the first pressure when compressor 210 is in operation. First chamber 214 is alternatively referred to as the low pressure side, while second chamber 246 is referred to as the high pressure side. Sealing means 236 may assume a number of different forms, as will be developed, as long as sealing means 236 substantially segregates fluids in first chamber 214 from fluids in second chamber 246 and maintains the fluids in first chamber 214 at a first suction pressure and fluids in second chamber 246 at the higher pressure (i.e. above the first pressure) preferably at or near compressor portion 218 discharge pressure when compressor 210 is energized or in operation. The pressure in second chamber 246 will remain at a higher pressure than in first chamber 214 for a period of time after compressor 210 ceases operation.

Physically, a compressor portion 218 is positioned below sealing means 236 in second chamber 246 so that compressor portion 218 is maintained at second, high pressure when compressor 210 is in operation. First chamber 214 at suction pressure is positioned above sealing means 236.

Housing includes a suction tube inlet 220 and a motor 224 located in first chamber 214. Suction tube inlet is located above motor 224. Adjacent suction tube inlet 220 inboard from housing 212 and substantially above motor 224 is an optional deflection plate 225. Deflection plate 225 makes an angle with respect to the centerline of suction tube inlet and may be mounted within first chamber 214 by any convenient means, such as by welding, brazing or by a suitable fastening means, such as by bolting. It can even be removably inserted across the boundary of housing 212 if a suitable sealing means (not shown) is provided and may be movable by remote operation. The method of mounting is not important, so long as the deflection plate, once assembled into position, is sufficiently rigid that it cannot vibrate freely so as to create undesirable sound or such that cyclic vibration will cause premature failure of the plate. The angle will vary from almost horizontal, preferably at least about 5° to nearly vertical, but preferably less than about 80°.

Motor 224 is a typical electrical motor having a plurality of windings forming a motor stator 226. Motor 224 includes a rotor 228 assembled to a rotatable shaft 230 that extends across sealing means 236. The rotor is mounted on the first or upper end of the shaft 230 located in first chamber 214. Shaft 230 is supported by upper motor bearings 232 in first chamber 214.

Compressor portion is mounted to the lower end of shaft 230 in second chamber 246, and shaft is supported by lower motor bearings 234, also located in second chamber 246. Lower end of shaft 230 extends downward into lubricant sump 248 and includes a passage 250 in the lower end of shaft that is immersed in lubricant, which accumulates in the sump after being separated from the discharge gas. Rotation of shaft 230 when motor 224 is energized causes lubricant to be drawn up shaft 230 and distributed onto wear and rotating parts of compressor portion and bearings through lubricant supply holes. A tube 242 extends through a wall of the housing 212 of the first chamber 214, connecting this first chamber with compressor suction inlet 240. In this embodiment, tube 242 extends substantially vertically downward external to housing 212 and then once again extends through a wall of housing 212 into second chamber 246 where it connects to compressor suction inlet 240.

Figure 4:
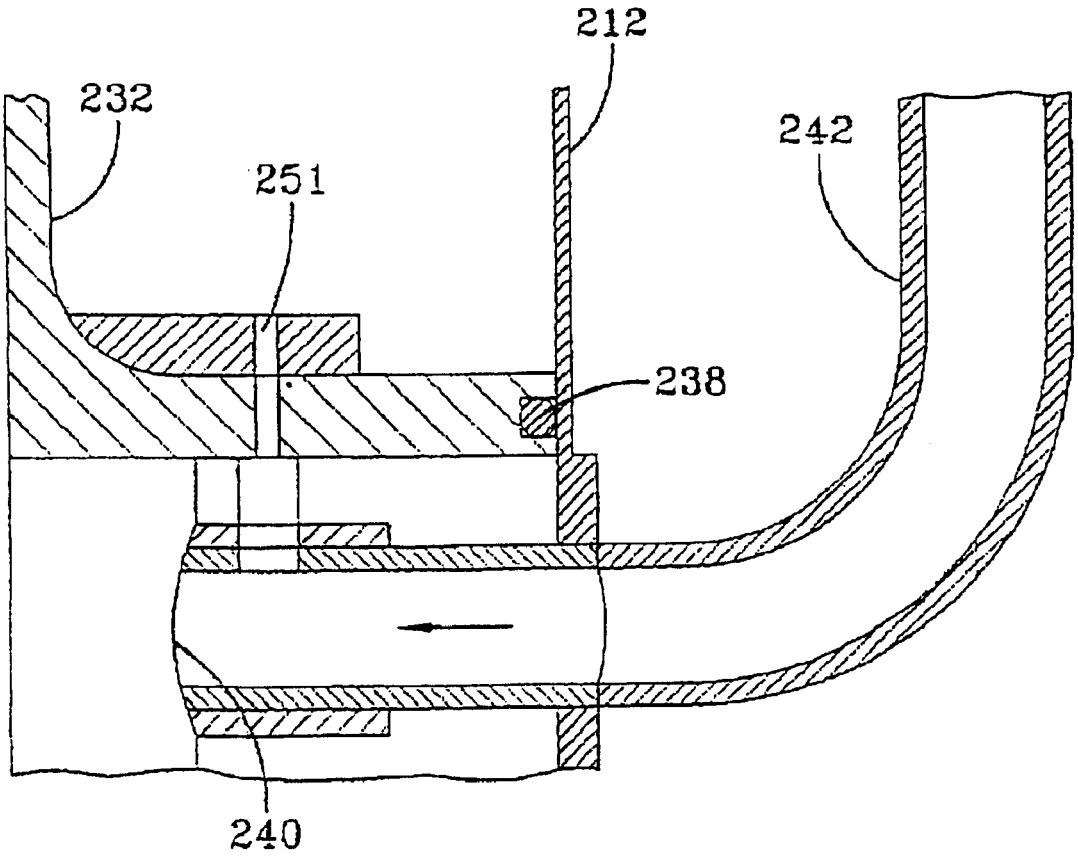
FIG. 4 is an enlarged view of the portion of the compressor of FIG. 3 that includes the lubricant liquid bleed aperture.

In the embodiment shown in FIG. 3, sealing means 236 is comprised of upper motor bearings 232 and at least one seal 238. The bearings 232 and at least one seal 238 substantially act to separate first chamber 214 from second chamber 246 in order to maintain the pressure differential between the chambers. A liquid bleed connection 251 extends through sealing means 236, and in this embodiment, better shown in FIG. 4, which is an expanded view of FIG. 3 in the region of the bleed connection, through upper motor bearings 232 to provide fluid communication between first chamber 214 and compressor suction inlet 240. This fluid communication is via tube 242 for refrigerant and liquid bleed connection 251 for liquid (lubricant) in this embodiment. Operation of the compressor draws refrigerant into compressor suction inlet 240, but also draws a metered amount of lubricant through liquid bleed connection 251. Liquid bleed connection 251 and be a second tube extending across sealing means as shown in FIG. 3 to place suction inlet 240 into fluid communication with the portion of first chamber 214 where liquid accumulates. However, connection can be any other arrangement such as an aperture through sealing means 236 and a second tube between the aperture and tube 242.

Sealing means 236 that separates first chamber 214 at low pressure from second chamber 246 at higher pressure is not restricted to a seal used in conjunction with bearings 232. Any convenient sealing means may be used, as long as the first chamber 214 can be maintained at a low pressure and be separated from second chamber 246 maintained at high pressure, and a communication means such as liquid bleed connection 251 is available that permits movement of liquid accumulated in the accumulator portion of first chamber 214, sealing means 236 of FIG. 3, to move into the compressor suction inlet 240. For example, sealing means may be accomplished with a separate partition plate (not shown) positioned above compressor portion 218 and either above or below upper bearing 232. This plate can be sealed using a seal, such as seal 238 described above. The partition plate can be press fit into housing 212 or may even be welded into place to accomplish the sealing. Other sealing arrangements also may be used, and sealing is not restricted to the exemplary embodiments discussed herein. For example a seal 238 can be provided between compressor 210 and housing 212 to prevent fluid passage between chambers 214 and 246 in order to maintain the pressure differential. A seal 238 (not shown) can be provided between lower bearings 234 and housing 212. The location of the sealing means is not important, only that the sealing means is positioned to provide a seal between the high pressure side or chamber and the low pressure side or chamber to maintain the pressure differential. The manner of accomplishing the sealing is not fundamentally a limiting feature of this invention, as long as the function is effectively accomplished.

In operation of the compressor embodiment shown in FIG. 3, fluid from an evaporator, such as evaporator 50 in HVAC system of FIG. 1, is supplied to compressor 210 via conduit means 15 to suction tube inlet which is physically located above the motor at the top of housing 212, entering first chamber 214 at its upper end. This fluid may be in the form of refrigerant gas or it may be refrigerant gas with entrained liquid, with some of the liquid including lubricant, which may be in the form of a mist. On entering housing 212, the fluid strikes at least one deflection plate 225. Deflection plate 225 is positioned to deflect fluid entering first chamber 214, preferably so that a portion of the fluid will be directed in a downward direction toward the motor. The deflection plate may assume any angle with respect to the incoming fluid, so long as it does not cause the incoming fluid to rebound causing a back pressure of fluid at suction tube inlet 220. Thus, a deflection plate oriented in a plane perpendicular to the flow of incoming fluid, or in a plane substantially perpendicular to the plane would be undesirable. However, a deflection plate oriented in a plane angled horizontally or angled vertically to the flow of incoming fluid, such as at an angle of about 5 to about 85°, and most preferably at an angle of 30–60° so as to deflect incoming fluid without causing a back pressure in suction tube inlet 220 will provide an acceptable flow path for the fluid. A portion of this fluid, substantially as refrigerant gas, will move toward and into tube 242 as a result of suction from compressor operation and a portion will circulate around the motor to cool the stator before ultimately flowing into tube 242.

More importantly, deflection plate 225 will direct any liquid refrigerant and lubricant downward in the direction of the motor and away from tube 242. Deflection plate 225 will also cause fine mists of lubricant or lubricant mixed with refrigerant to coalesce thereon. These mists will coalesce on deflection plate 225 until a critical size is reached, at which time they will form droplets and fall downward toward the motor 224. As these fluids fall downward, the fluids will contact the stator and its windings and cool the windings. As noted, these fluids contain lubricant, liquid refrigerant, or a mixture of the two. The lubricant will substantially continue by gravity downward and will accumulate on sealing means 236. A portion of liquid refrigerant, as it absorbs heat from the stator windings, will undergo a phase transformation and be converted to gas, being drawn upward and into tube 242, drawing additional heat from stator 226 as it rises. This gas will ultimately be drawn into tube 242 and compressor portion by the suction pressure of the operating compressor. In a similar fashion, fluid containing a mixture of lubricant and refrigerant can be separated. The refrigerant undergoes a phase change into a gas at a lower temperature than the lubricant. The refrigerant will thus be the first component of the mixture to undergo this phase change as it absorbs heat from the stator 226, while the lubricant drops downward onto seal means 236, where it accumulates.

At least one liquid bleed connection 251 extends across seal means 236 to place first chamber 214 into communication with compressor suction inlet 240. Flow of liquid through liquid bleed aperture 251 can be accomplished by any one of a number of conventional and well known means. For example, flow may be controlled by sealing means and a float valve (not shown) that is activated when the level of lubricant above the sealing means rises above a predetermined level which causes activation of the valve. It can be activated by hydrostatic pressure of fluid on sealing means. It can be activated when the motor is energized. It can be designed so that pressure in the first chamber or the second chamber activates the valve causing fluid to be pushed through the valve. The liquid bleed connection can simply act by gravity flow of fluid. The method of transferring liquid across sealing means 236 is not critical to operation of this invention, and any effective means of controlling the flow of lubricant across this boundary may be used. The purpose of this connection is to allow lubricant that accumulates on and above sealing means 236 to flow across seal means into the suction inlet 240. The amount of lubricant that flows through the connection will depend upon the size of the connection, which can be varied as desired. In a preferred embodiment, liquid is drawn into connection 251 from first chamber 214 into tube 242 as a result of suction pressure at the compressor suction inlet 240 due to operation of the compressor.

Lubricant, having a higher density, will accumulate on and above sealing means 236. Liquid refrigerant being of lower density, will be located on top of the lubricant under static conditions. It will be recognized that under dynamic conditions hen the compressor is in operation), as the rotor rotates, there will be some mixing of lubricant and refrigerant. When the compressor is not in operation, if the accumulation of refrigerant over the lubricant is substantial as a result of design or usage, a stator winding, such as a start winding, can be energized. This winding can be provided a sufficient amount of current to heat the winding without causing rotation of motor shaft 230. The winding can be activated as a result of detection of a preselected condition, such as for example, a temperature or the height of the liquid column accumulated in first chamber 214, or can be energized as a timed function prior to activation of compressor 210. The heat generated by this winding should be sufficient to convert refrigerant in the liquid phase in first chamber 214 to its gaseous phase.

Refrigerant gas entering tube 242, which is in fluid communication with compressor portion 218, is drawn into compressor suction inlet 240 and then into the working zone of compressor portion 218. The compressed refrigerant exits compressor discharge port 244, moving in the direction shown by the arrows in FIG. 3 through second chamber 246, into discharge outlet 222 as a high pressure gas and into HVAC system where it is transported by conduit 15, to for example, condenser 20 as shown in FIG. 1. FIG. 3 also shows a weighted disk 262 that is secured to shaft 230 as a balancing weight to counteract eccentric loads on shaft 230 introduced by operation of rotor 228 and compressor 218. The weighted disk eliminates the need for balancing weights on the upper end of rotor 228. The disk 262 also acts as a lubrication separation device, and can serve that function in this invention. However, the walls of the second chamber and baffle 258 also can serve to help separate entrained lubricant from compressed refrigerant. As compressed refrigerant, which contains a small amount of metered, entrained lubricant, strikes the disk, the walls and/or the baffle as it exits the compressor portion 218, some of the lubricant will be caused to separate due to contact with these structures. Ideally, all of the entrained lubricant is separated from the refrigerant before being discharged through discharge outlet 222.

Placement of the motor 224 in a cooler first chamber 214 permits the compressor system to operate in environments with high ambient temperatures and for longer duty cycles without adversely affecting motor performance or shortening motor life. In this embodiment, cooling is provided to the motor not only by refrigerant gas, but also by liquid refrigerant and lubricant. The heat drawn from the stator also assists in separating the liquid refrigerant from lubricant. An added benefit of this system is that an external accumulator can be eliminated, thereby reducing the amount of space required to install a compressor. The compressor of the present invention also reduces slugging concerns by metering small amounts of lubricant to the compressor suction inlet during compressor operation, so large quantities of liquid are not readily available to be drawn into the compressor suction inlet 240 during initial compressor operation. Finally, because refrigerant can be effectively separated from lubricant and then metered back into the system in a controlled manner with refrigerant gas, there is less of a probability that lubricant will be washed from wear surfaces by liquid refrigerant.

Figure 5:
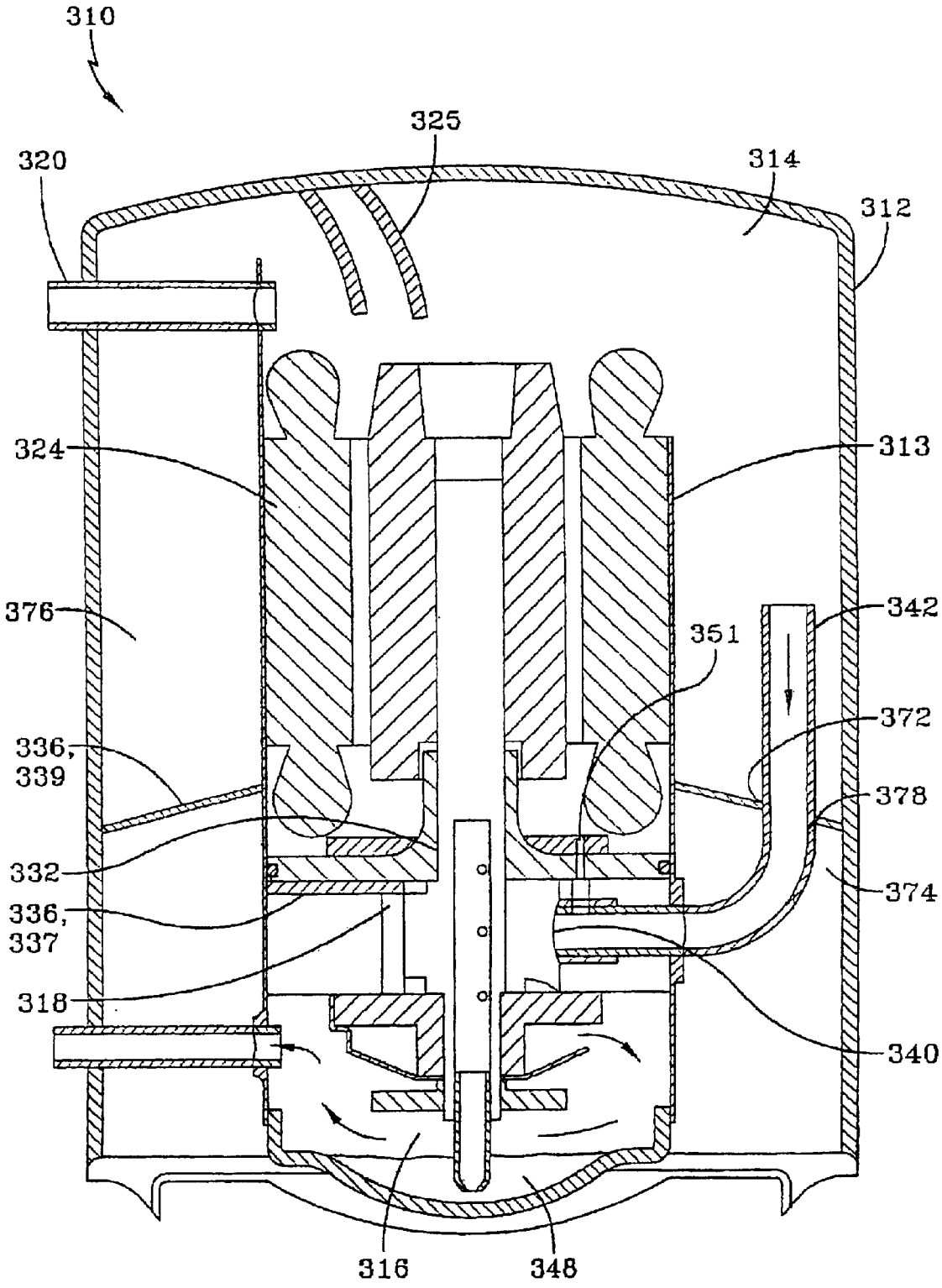
FIG. 5 is a cross-section of a second embodiment of the compressor of the present invention that can be used to replace the compressor and accumulator in a HVAC system of FIG. 1.

FIG. 5 is a cross section of a compressor 310 which is a second embodiment of the present invention. This embodiment differs from the first embodiment in that tube 342 that provides fluid communication between first chamber 314 and suction port 340 is positioned internal to housing 312. This results in housing 312 that is larger than housing 212 set forth in the first embodiment, and therefore resulting in a slightly higher cost. There is also a space and weight penalty for this design, which will not be a factor for certain applications. In this embodiment, suction tube inlet 320 extends into first chamber first chamber so that fluid is discharged over motor 324. Fluid from inlet 320 strikes deflection means 325 which in this embodiment is a plurality of vanes positioned in the flow path of the incoming fluid. The vanes deflect the incoming fluid, performing the same function in substantially the same way as deflection plate 225 in FIG. 3 of the first embodiment, so the description and operation will not be repeated.

In this embodiment, sealing means is again accomplished by upper bearing 332 and a second partition plate 339. Upper bearing 332 is positioned in secondary housing 313 in a manner similar to that shown in FIG. 3. Second partition plate 339 is positioned between secondary housing 313 and housing 312. Second partition plate 339 may be press fit, welded or otherwise assembled. As shown, second partition plate 339 is not assembled horizontally, but preferably forms an angle with respect to a horizontal plane passing through compressor 310. Alternatively, it may be radiused. The plate is positioned so that fluid will accumulate at a low point of the plate. Tube 342 extends partially upward above second partition plate 339, but terminates in first chamber cavity region.

Operation of this second embodiment is substantially similar to that of the first embodiment. The motor is cooled in substantially the same way, and lubricant is accumulated on bearing 332, from where it is metered to compressor suction inlet 340 through bleed aperture 351 in bearing 332. The difference in this embodiment is that refrigerant fluid does not move into a tube such as tube 242, a portion of which is physically external to compressor 310. Rather fluid which includes refrigerant first passes into first chamber cavity region, which acts as a secondary separation means. Some mist or droplets of lubricant may, by gravity or as a result of contact with housing 312 and secondary housing 313, be segregated from refrigerant gas and fall downward onto second partition plate 339. This amount of lubricant, although small, will accumulate over time. An opening 378 is provided across partition plate 339 and into tube 342 so that lubricant can be metered into tube 342 which is in fluid communication with compressor suction inlet 340. It will be understood that although an aperture across plate 339 is shown adjacent to tube 342, and fluid communication between the upper side of plate 339 and suction inlet 340 of the compressor, such as for example, a tube, will provide a flow path for the lubricant and prevent excessive accumulation of lubricant. As shown in FIG. 5, refrigerant gas passes into tube 342 and is channeled to compressor portion 318 where it is acted on as previously set forth in the first embodiment, while lubricant can be metered from aperture 351 or opening 378 if sufficient lubricant has accumulated on second partition plate 339.

Figure 6:
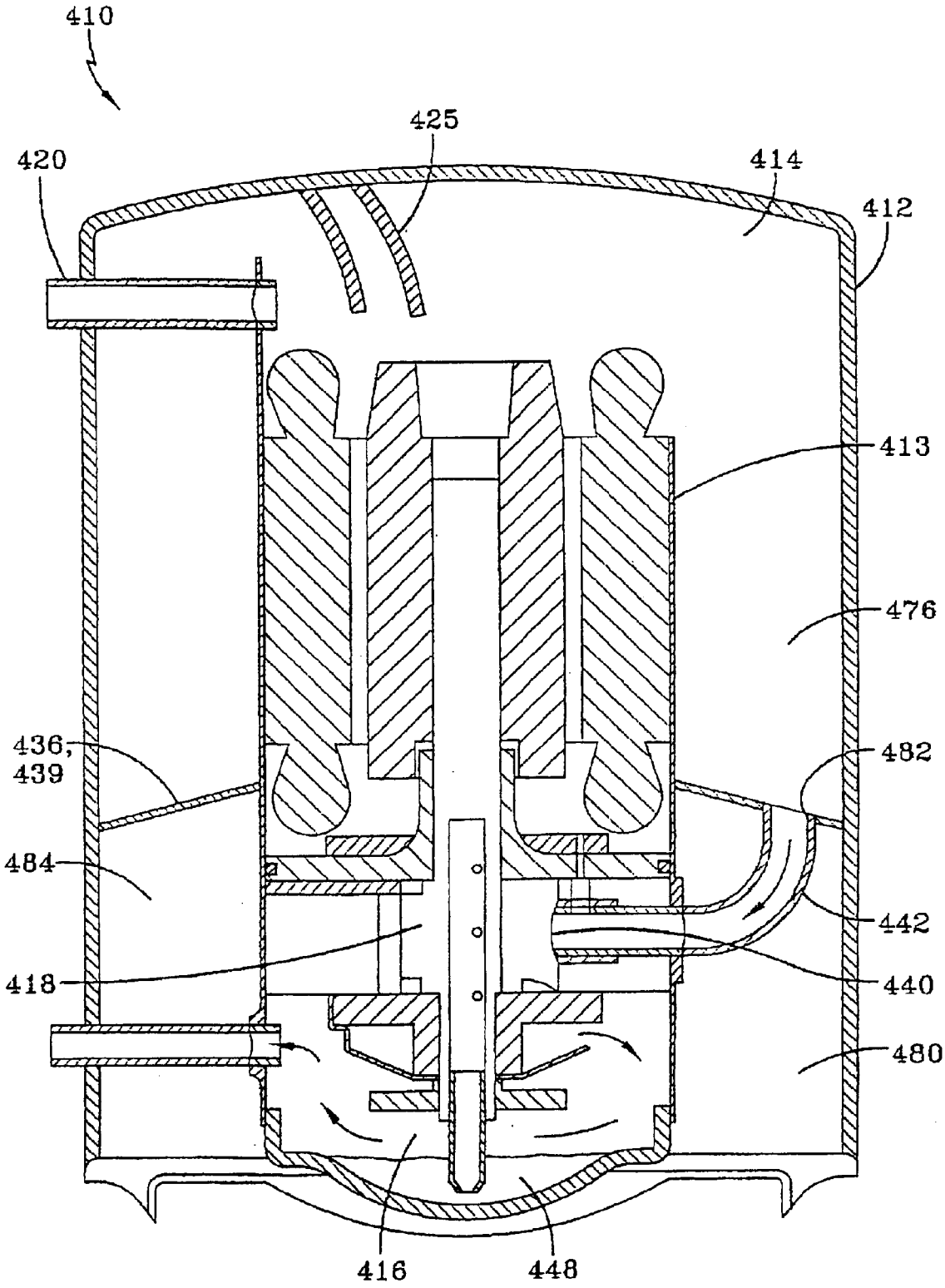
FIG. 6 is a cross-section of a third embodiment of the compressor of the present invention, which is a variation of the embodiment shown in FIG. 4, that can be used to replace the compressor and accumulator in a HVAC system of FIG. 1.

Further, a portion of tube 342 above second partition plate 339 can be eliminated, as long as fluid communication is provide between first chamber 314 and compressor suction inlet 340. FIG. 6, which depicts such a configuration, is a third embodiment of the present invention and therefore is substantially similar to the embodiment depicted in FIG. 5. In compressor 410, tube 442 does not extend upward into first chamber cavity region 476. Rather, tube 442 is received by second opening 482 in second partition plate 439 which forms a portion of sealing means 436 between first chamber 414 and second chamber 416. Tube 442 extends across a second chamber cavity region 484 which is at high pressure. Tube 442 provides fluid communication between first chamber cavity region 476 which is at low pressure and compressor suction inlet 440. Second chamber cavity region 484 is a region within second chamber 416 defined by housing 412, secondary housing 413 and second partition plate 439. A small portion of gas, mist or droplets which condense and flow onto second partition plate 439 may flow into tube 442 in this design. However, this amount of fluid is small and should not create slugging concerns. Operationally, this embodiment otherwise performs identically of the compressor embodiment depicted in FIG. 5. No separate opening such as opening 378 of FIG. 5 is required in this embodiment. The angling or shaping of partition plate 339, 439, such as with a radius, directs the lubricant flow to a low point, which may be tube 442 itself, so that it can be readily metered into tube 342, 442 or otherwise entrained into the refrigerant gasteam prior to entering compressor suction inlet 340, 440.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A split compressor, comprising:

a first housing;

a secondary housing, the secondary housing being within the first housing;

a sealing means positioned within the first housing and the secondary housing defining a low pressure chamber and a high pressure chamber, the low pressure chamber being located above the high pressure chamber, the sealing means maintaining a pressure differential between the low pressure chamber and the high pressure chamber and preventing fluid communication between the low pressure chamber and the high pressure chamber;

a motor disposed within the secondary housing of the low pressure chamber;

a compressor portion located within the high pressure chamber, the compressor portion operably connected to the motor, the compressor portion having a compressor suction inlet and a compressor discharge port;

a suction tube inlet extending into the low pressure chamber, the suction tube inlet introducing a fluid from outside the compressor through the first housing into the low pressure chamber;

means for deflecting the fluid positioned substantially adjacent the suction tube inlet;

an accumulator positioned within the low pressure chamber above the sealing means, the sealing means forming a lower boundary of the accumulator;

a channeling means to provide fluid communication of a substantially gas stream between the low pressure chamber and the compressor suction inlet, the channeling means extending across the sealing means and internal to the first housing;

an orifice through the sealing means providing fluid communication between the internal accumulator and the compressor suction inlet to allow liquid fluid accumulated in the internal accumulator to move in a controlled fashion across the sealing means from the low pressure chamber to the compressor suction inlet where it is mixed with the gas stream, compressed and discharged into the high pressure chamber;

a means for providing a second fluid communication between the low pressure chamber and the compressor suction inlet between a first housing wall and a secondary housing wall to allow liquid fluid accumulated on the sealing means between the first housing wall and the secondary housing wall to move across the sealing means to the compressor suction inlet where it is compressed and discharged;

a lubrication sump positioned within the high pressure chamber for receiving and storing lubricant discharged into the high pressure chamber;

a discharge outlet to provide a discharge path for compressed gas from the compressor portion; and wherein fluid passing into the compressor portion through the compressor suction inlet is compressed and discharged through the compressor discharge port into the high pressure chamber, and then discharged from the high pressure chamber through the discharge outlet.

2. The compressor of claim 1 wherein the sealing means includes a partition plate and a bearing assembly, the partition plate sealingly positioned within the first housing between the first housing wall and the secondary housing wall, and the bearing assembly sealingly positioned within the secondary housing wall, the partition plate and bearing assembly defining the low pressure chamber and the high pressure chamber, the low pressure chamber being located above the high pressure chamber within the compressor, the partition plate and bearing assembly maintaining a pressure differential between the low pressure chamber and the high pressure chamber and preventing fluid communication between the low pressure chamber and the high pressure chamber.

3. The compressor of claim 2 wherein the channeling means that provides fluid communication of a substantially gas stream between the low pressure chamber and the compressor suction inlet extends across and above the partition plate.

4. The compressor of claim 3 wherein the partition plate is not flat with respect to a horizontal plane passing through the compressor to collect liquid in a predetermined location on the plate.

5. The compressor of claim 4 wherein the partition plate is at an angle with respect to a horizontal plane passing through the compressor to collect liquid in a predetermined location on the plate.

6. The compressor of claim 4 wherein the partition plate forms a radius to a horizontal plane passing through the compressor to collect liquid in a predetermined location on the plate.

7. The compressor of claim 4 wherein the means for providing a second fluid communication includes providing a second fluid communication from a predetermined location on the plate to the compressor suction inlet.

8. The compressor of claim 3 wherein the means for providing a second fluid communication through the sealing means includes a fluid connection across the partition plate into the channeling means.

9. The compressor of claim 4 wherein the fluid connection is a tube.

10. The compressor of claim 4 wherein the fluid connection is an orifice.

11. The compressor of claim 2 wherein the partition plate is not flat with respect to a horizontal plane passing through the compressor to collect liquid in a predetermined location on the plate.

12. The compressor of claim 11 wherein the channeling means between the low pressure chamber and the compressor suction inlet does not extend above the partition plate.

13. The compressor of claim 12 wherein the means for providing a second fluid communication between the low pressure chamber and the compressor suction inlet is the channeling means that moves collected liquid across the partition plate from a preselected location on the plate to the compressor suction inlet.

14. The compressor of claim 11 wherein the partition plate is at an angle with respect to a horizontal plane passing through the compressor to collect liquid in a predetermined location on the plate.

15. The compressor of claim 11 wherein the partition plate forms a radius to a horizontal plane passing through the compressor to collect liquid in a predetermined location on the plate.

16. The compressor of claim 1 wherein the sealing means includes a motor bearing with a seal affixed within the secondary housing wall.

17. The compressor of claim 1 wherein the sealing means includes a plate within the secondary housing.

18. The compressor of claim 1 further including a means to control the flow of liquid between the internal accumulator and the compressor inlet port so as to reintroduce liquid in the form of lubricant into a gas stream in a controlled fashion.

19. The compressor of claim 18 wherein the orifice in the sealing means for providing fluid communication between the internal accumulator and the compressor suction inlet further includes a valve that is activated in response to a predetermined condition.

20. The compressor of claim 1 further including a compressor portion which discharges compressed fluid from the compressor discharge port into a second chamber on the high pressure side before the compressed fluid is discharged through the discharge outlet of the compressor, the second chamber including at least one surface upon which the discharged gas impinges.

21. The compressor of claim 1 further including means for heating liquid accumulated in the internal accumulator.

22. The compressor of claim 21 wherein the means for heating liquid in the internal accumulator includes at least one winding of the motor.

* * * * *

UNITED STATES PATENT AND TRADEMARK OFFICE

CERTIFICATE OF CORRECTION

PATENT NO. : 6,807,821 B2
DATED : October 26, 2004
INVENTOR(S) : Narnoy II, John Kenneth It is certified that error appears in the above-identified patent and that said Letters Patent is hereby corrected as shown below:

Column 9,
Line 12, "Conditions Hen" should read -- Conditions (i.e. when --.

Column 11,
Line 27, "gasteam" should read -- gas stream --.

Column 12,
Line 43, "compressor," should read -- compressor; --.

Signed and Sealed this

First Day of March, 2005

JON W. DUDAS
*Director of the United States Patent and Trademark Office*